US009899009B2

(12) United States Patent
Ng

(10) Patent No.: US 9,899,009 B2
(45) Date of Patent: Feb. 20, 2018

(54) GUITAR CAPO WITH UNIVERSAL DEVICE MOUNT

(71) Applicant: Ernie Chak-Tin Ng, Long Island City, NY (US)

(72) Inventor: Ernie Chak-Tin Ng, Long Island City, NY (US)

( * ) Notice: Subject to any disclaimer, the term of this patent is extended or adjusted under 35 U.S.C. 154(b) by 0 days.

(21) Appl. No.: 15/207,717

(22) Filed: Jul. 12, 2016

(65) Prior Publication Data

US 2017/0025103 A1 Jan. 26, 2017

Related U.S. Application Data

(60) Provisional application No. 62/194,992, filed on Jul. 21, 2015.

(51) Int. Cl.
*G10D 3/04* (2006.01)

(52) U.S. Cl.
CPC ..... *G10D 3/043* (2013.01)

(58) Field of Classification Search
CPC ..... G10D 3/043
See application file for complete search history.

(56) References Cited

U.S. PATENT DOCUMENTS

| | | | | |
|---|---|---|---|---|
| 713,310 | A * | 11/1902 | Kappeler | G10D 3/043 84/318 |
| 8,809,655 | B1 * | 8/2014 | Warwick | G10D 3/043 84/318 |
| 9,230,519 | B1 * | 1/2016 | Beller | G10D 3/00 |
| 9,761,208 | B1 * | 9/2017 | Klick, Jr. | G10G 7/00 |
| 2017/0025103 | A1 * | 1/2017 | Ng | G10D 3/043 |

* cited by examiner

*Primary Examiner* — Robert W Horn
(74) *Attorney, Agent, or Firm* — Gutwein Law; Greg N. Geiser

(57) ABSTRACT

Described herein is a combination guitar capo with universal electronic device mount for placement onto a guitar. The mount allows a user to view the attached device while playing the guitar.

6 Claims, 4 Drawing Sheets

GUITAR CAPO WITH UNIVERSAL DEVICE MOUNT

CROSS REFERENCE TO RELATED APPLICATIONS

This application claims priority to U.S. Provisional Patent Application No. 62/194,992 filed 21 Jul. 2015 to the above named inventor, and is herein incorporated by reference in its entirety.

FIELD OF THE INVENTION

The invention relates generally universal device mount for engagement with a guitar capo.

BACKGROUND

Currently there are a number of solutions for reading music, recording music and using a personal electronic device while playing a guitar. Some of these solutions attempt to use a traditional music stand, but these solutions fail to meet the needs of the market because the music stand requires the player to sit a location in view of the stand and otherwise preventing movement of the player. Other solutions attempt to use an apparatus or object to rest the personal electronic device against, but these solutions are similarly unable to meet the needs of the market because the personal electronic device may fall or be positioned at an angle that is difficult to view.

SUMMARY OF THE INVENTION

It would be advantageous to have an apparatus that is a combination guitar capo and electronic device holder and more specifically designed for holding a smartphone device. Furthermore, it would also be advantageous to have an apparatus that holds the smartphone in a very accessible and viewable position on the guitar neck so the player can read sheet music or guitar tablature displayed on the personal electronic device. Therefore, there currently exists a need in the market for an apparatus that provides the full functions of a capo with a mounting system which is universal to all smartphone or similarly sized personal electronic devices for the purpose of allowing a guitar player to access software applications or view music or tablature while playing.

The invention advantageously fills the aforementioned deficiencies by providing a universal mounting apparatus for placement on a guitar capo, which provides all the functions of a capo with the added ease of access to all of the uses a smartphone or personal electronic device can provide the guitar player while they play, such as accessing sheet music on the Internet.

The invention is a fully functional capo with a universal mounting apparatus for securing a personal electronic device and placing it an improved angle for viewing.

The apparatus has a device mount that is received on an arm of the capo that is adaptable to multiple sizes of devices. The mount is movable in multiple directions allowing the retained electronic device to be alternately viewed in a portrait or a landscape format. In alternate embodiments of the present invention, the device is mounted to the capo through a closed-ball and socket configuration allowing the user the ability and capability of swiveling or moving the phone, or other electronic device, in different directions and positions depending upon the user's preferred position during playing. In another embodiment of the present invention, the device is removably received on a standard capo by engaging an arm of the capo, wherein the device includes a spring member that is secured within a cooperating shape of the capo arm.

The apparatus has a pair of clamping arms in communication with the mount and providing opposed forces to the personal electronic device to keep the electronic device secured within the mounting apparatus.

The apparatus fulfills the need for access to online or stored content while playing a guitar.

Among other things, it is an advantage of the invention to provide a guitar capo with universal phone mount that does not suffer from any of the problems or deficiencies associated with prior solutions.

It is still further an advantage of the invention to have an anodized aluminum frame with vulcanized rubber on the capo.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
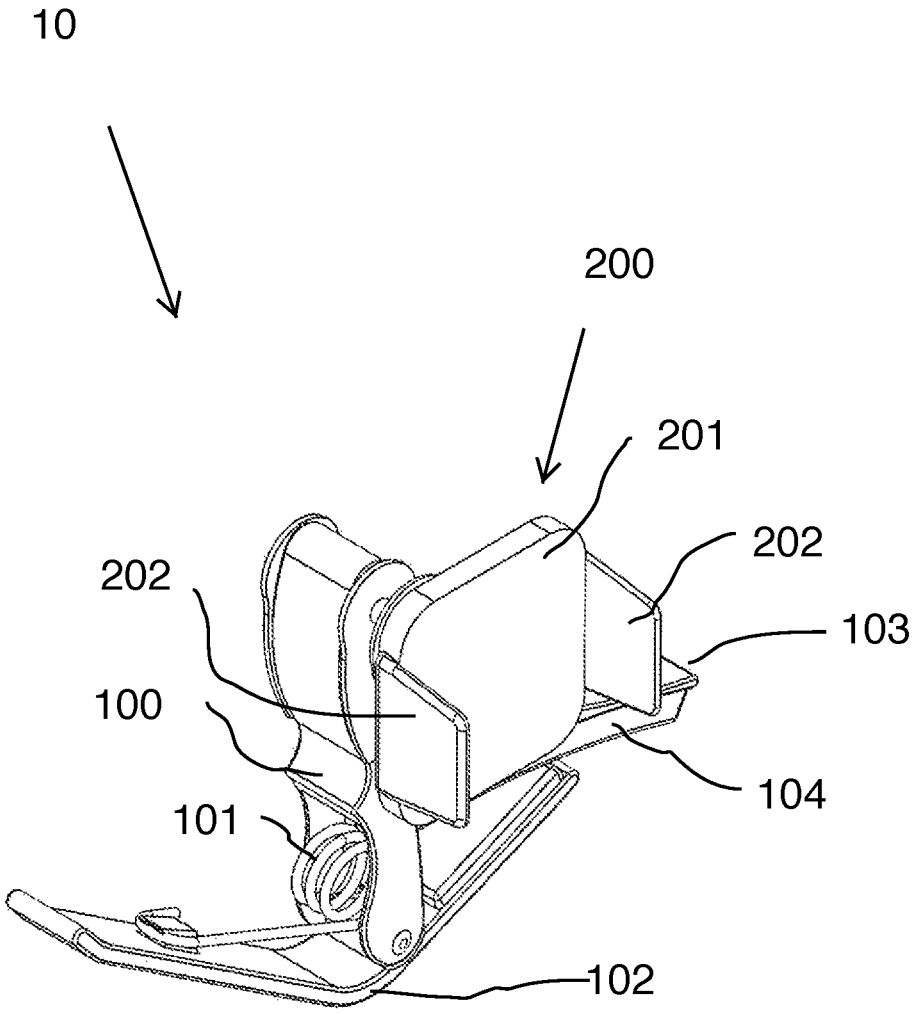
FIG. 1 shows a perspective view of the device, according to the present invention.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful, and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative to the apparatus.

These terms are not meant to limit the elements that they describe, as the various elements may be oriented differently in various applications.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

The invention is directed to be a combination guitar capo with a universal personal electronic device or smartphone device mount.

The invention is a fully functioning guitar capo with a mounting apparatus that secures a personal electronic or smartphone sized device to be fastened to the guitar neck so the player can easily view their device to read music, play music, call or record what they need on their smartphone or similar electronic device.

Figure 2:
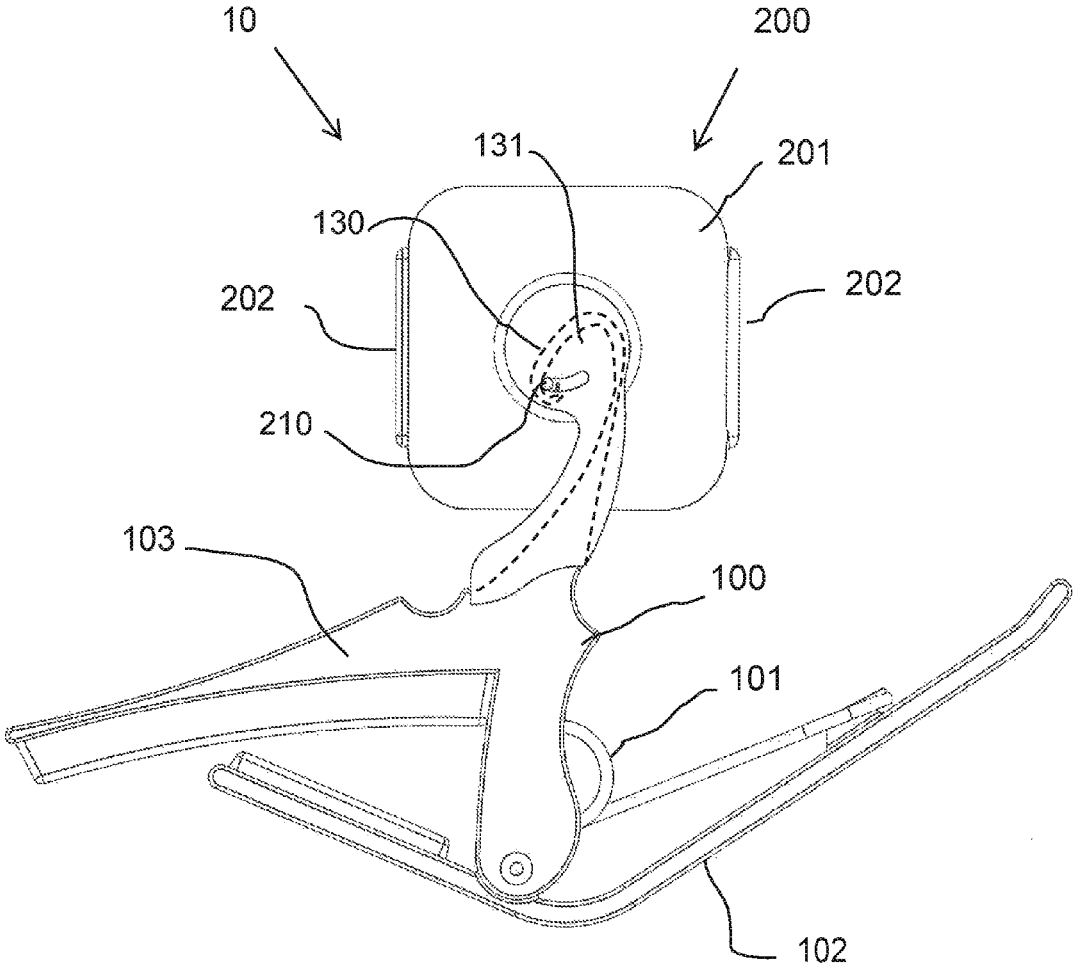
FIG. 2 shows a side view of the device, according to the present invention.
Figure 3:
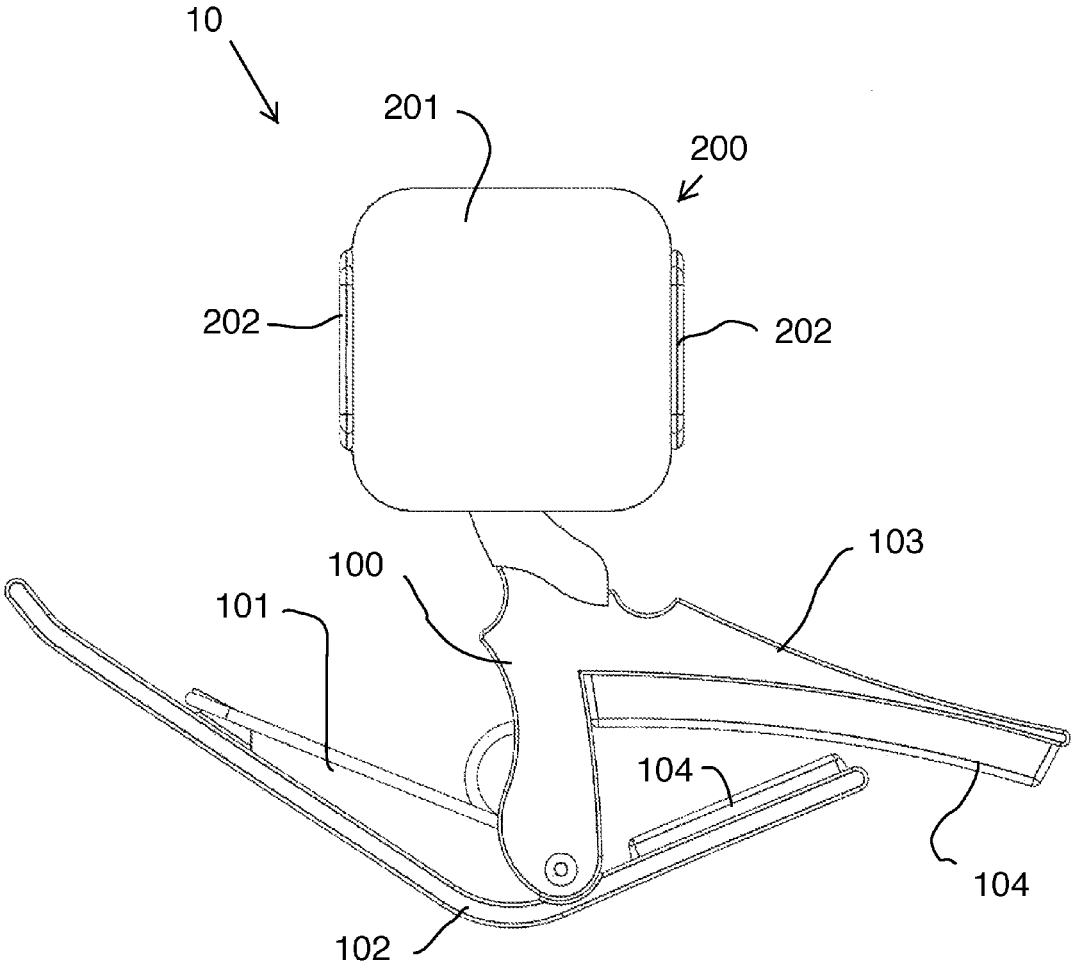
FIG. 3 shows an opposed side view of the device, according to the present invention.

Referring to the figures, FIGS. 1-3 show the combination guitar capo and electronic device mount generally referred to as device 10. The device 10 is incorporated onto a guitar capo 100. The guitar capo 100 is of the standard type and generally comprised of a spring member 101 in hinged communication with a pair of arm portions 102, 103. A first arm portion 102 designed to engage the back portion of a guitar neck and a second arm portion 103 designed for engagement with the fingerboard of the guitar neck to arrest the strings of the guitar at the position the capo 100 is placed, typically adjacent to a fret. The spring member 101 provides a compressive or clamping force to the pair of arms, wherein the capo 100 raises the pitch of strings by shortening the string length. Alternately, the capo 100 of the present invention can be engaged with the headstock at the guitar end. The clamping portions of the first arm 102 and second arm 103 of the capo 100 include rubber pads 104 to improve durability, effectiveness, and offer protection for the guitar surfaces.

A universal electronic device mount 200 is in coupled communication with the capo 100 wherein placement of the capo 100 onto the neck of a guitar allows a user to view an electronic device received within the universal mount 200. The universal mount 200 is coupled to the capo 100 and includes a generally planar surface 201 providing a backing support for placement of the device within the mount. This planar surface 201 is generally movable rotationally wherein the surface 201 can be moved within an arc of 90 degrees, allowing the electronic device to be viewed in either a portrait or landscape configuration. A pair of clamping members 202 are located on opposed sides of the planar surface 201 and provide a compressive force to an affixed electronic device. These clamping members 202 are adjustable wherein the device 10 can accommodate electronic devices of multiple sizes and shapes.

The device mount 200 can be removably received on an arm 102, 103 of the capo 100, wherein the shape of arm 102, 103 is used to engage the mount 200 of the device 10. Accordingly, several capos 100 on the market have a curvature 130 of the second arm 103 of the capo 100 and forming a partially enclosed space 131. The device mount 200 backside includes a tab 210 designed for receipt within this space 131, wherein the mount 200 can be easily inserted and removed from this enclosed space 131 and within the curvature 130 of the second arm 103 of the capo 100.

Figure 4:
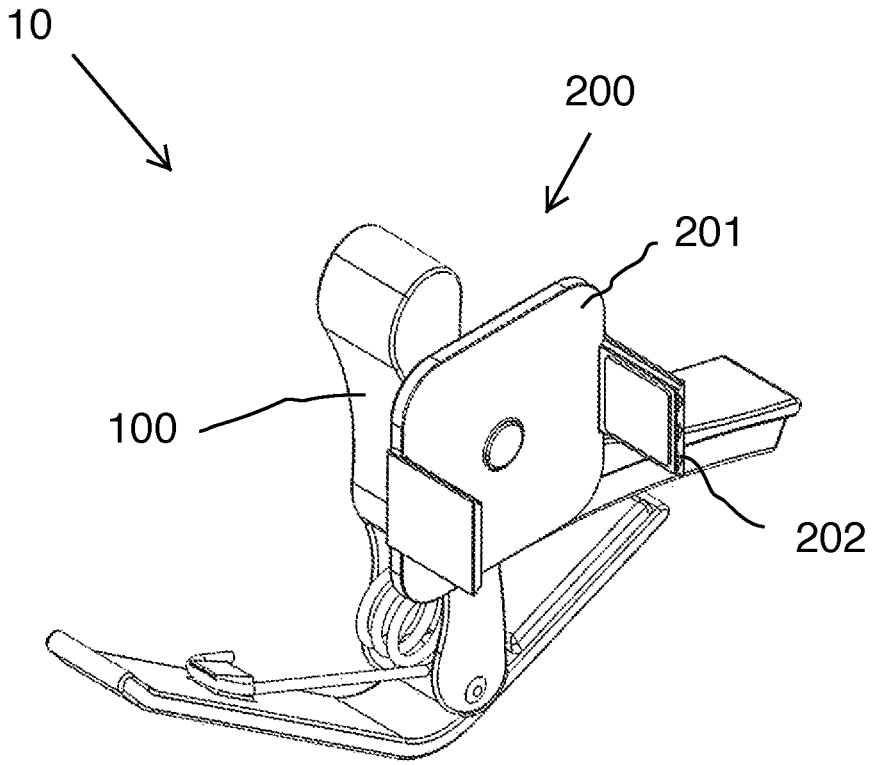
FIG. 4 shows a perspective view of an alternate embodiment of the device, according to the present invention.

In an alternate embodiment of the present invention (FIG. 4), the mount 200 is coupled to the capo 100 through a ball and socket type swivel connection 203, wherein the user can manipulate the direction and angle of the mount 200.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

The invention claimed is:

1. A capo for placement on a neck of a guitar, the capo comprising:

a first arm, the first arm engaging a back of the guitar neck;

a second arm, the second arm in hinged communication with the first arm, the second arm engaging a fingerboard on a front of the guitar neck and having a curvature forming an enclosed space; and a mounting device, the mounting device removably affixed within the enclosed space of the curvature, the mounting device including a pair of clamping members, the clamping members designed to secure a personal electronic device.

2. A capo as in claim 1, wherein the mounting device is in rotational communication with the second arm portion and wherein the mounting device is capable of at least 90 degrees of rotation.

3. A device for receipt on an arm of a guitar capo, the arm having a curvature defining an interior space, the device comprising:

a mounting plate, the mounting plate forming a planar surface and having a pair of clamping members, the clamping member designed to secure a personal electronic device;

an attachment means, the attachment means in communication with the mounting plate and coupled within the interior space on the arm of the capo.

4. The device as in claim 3, wherein the attachment means is further received within the curvature of the arm of the capo.

5. A device as in claim 3, wherein the attachment means is received over the arm of the capo.

6. A device as in claim 3, wherein the mounting plate is movable rotationally.

* * * * *